US007307508B2

(12) United States Patent
Komatsu

(10) Patent No.: US 7,307,508 B2
(45) Date of Patent: Dec. 11, 2007

(54) SLIDING RESISTOR HAVING EXCELLENT SLIDING DURABILITY

(75) Inventor: Hisashi Komatsu, Miyagi-ken (JP)

(73) Assignee: ALPS Electric Co., Ltd., Ota-Ku, Tokyo (JP)

( * ) Notice: Subject to any disclaimer, the term of this patent is extended or adjusted under 35 U.S.C. 154(b) by 381 days.

(21) Appl. No.: 10/993,000

(22) Filed: Nov. 18, 2004

(65) Prior Publication Data

US 2005/0109993 A1 May 26, 2005

(30) Foreign Application Priority Data

Nov. 26, 2003 (JP) ..... 2003-395236

(51) Int. Cl.
*H01C 10/30* (2006.01)
*H01B 1/24* (2006.01)

(52) U.S. Cl. ..... 338/160; 338/202; 252/511

(58) Field of Classification Search ..... 252/500, 252/511–514; 338/22 R, 160, 202; 528/335, 528/350, 176

See application file for complete search history.

(56) References Cited

U.S. PATENT DOCUMENTS 4,622,383 A * 11/1986 Araps et al. ..... 528/345
4,835,197 A * 5/1989 Mercer ..... 524/538
5,138,028 A * 8/1992 Paul et al. ..... 528/353
5,781,100 A 7/1998 Komatsu

* cited by examiner

*Primary Examiner*—Mark Kopec
(74) *Attorney, Agent, or Firm*—Beyer Weaver LLP

(57) ABSTRACT

A binder resin for sliding resistors contains an acetylene-terminated polyamic acid oligomer represented by the following general formula (I):

[Chemical Formula 1] (I)

wherein n is an integer of zero or more.

8 Claims, 2 Drawing Sheets

SLIDING RESISTOR HAVING EXCELLENT SLIDING DURABILITY

BACKGROUND OF THE INVENTION

1. Field of the Invention

The present invention relates to binder resins for sliding resistors included in potentiometers for use in, for example, on-vehicle sensors, and also relates to sliding resistors formed using the binder resins. In particular, the present invention relates to a binder resin that can provide a sliding resistor capable of withstanding 50 million, or more than 100 million, sliding movements, and a sliding resistor formed using the binder resin.

2. Description of the Related Art

A potentiometer is generally used as a variable resistor in, for example, on-vehicle sensors. This device includes a resistor that is typically formed with a binder resin in which conductive particles, such as carbon black, are dispersed, and a slider, such as a metal contact brush, that can be moved over the resistor to change its resistance.

The binder resin used is generally a thermosetting resin such as phenol resin and epoxy resin. Examples of the conductive particles used include carbon black and carbon fiber, which also serves to increase the durability to sliding movements. The resistor is formed by mixing and dispersing the conductive particles into the binder resin together with a solvent to prepare a resistor paste, applying the resistor paste directly onto an insulating substrate by, for example, screen printing, and firing the resistor paste.

For example, sliding components such as on-vehicle sensors installed in the vicinity of engines are exposed to increased temperatures of about 100° C. to 120° C. Sliding components used in such a hostile environment therefore need a resistor having high heat resistance. In recent years, polyimide resin has been frequently used as a binder resin for applications such as on-vehicle devices because this resin has high heat resistance.

Japanese Patent No. 3372636 (the corresponding U.S. Pat. No. 5,781,100), for example, discloses a method of producing a resistor substrate having excellent heat resistance, less variations in resistance due to heat, and a long life using an acetylene-terminated polyisoimide oligomer having a specific glass transition temperature as a binder resin.

A resistor substrate produced by the above method, however, has the problem that more than 50 million sliding movements cause an increase in contact resistance due to the wearing down of the resistor. On-vehicle sensors, for example, need a potentiometer having the durability to 50 million, or more than 100 million, sliding movements. Resistors included in potentiometers are therefore required to achieve a further improvement in sliding durability.

SUMMARY OF THE INVENTION

In light of the above circumstances, an object of the present invention is to provide a binder resin for forming a sliding resistor having excellent sliding durability to 50 million, or more than 100 million, sliding movements by a slider, and a sliding resistor formed using the binder resin.

To achieve the above object, the present invention provides a binder resin for sliding resistors that contains an acetylene-terminated polyamic acid oligomer represented by the following general formula (I):

(I)

[Chemical Formula 1]

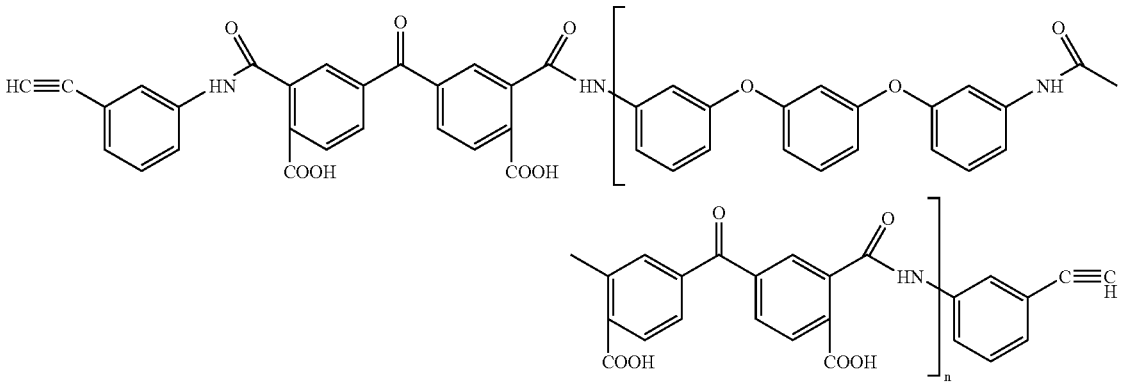

wherein n is an integer of zero or more.

A sliding resistor containing the above binder resin exhibits excellent sliding durability. The above acetylene-terminated polyamic acid oligomer can provide a higher crosslinking density in the heating and curing of a resistor paste containing the binder resin to increase the strength of the resistor, thus enhancing the sliding durability of the resistor.

In the general formula (I), n is preferably an integer of zero to four. If n is an integer of zero to four, the resistor paste containing the binder resin exhibits a viscosity suitable for application by, for example, screen printing, so that the sliding resistor becomes easier to produce.

The binder resin of the present invention preferably further contains an acetylene-terminated polyisoimide oligomer.

To achieve the above object, additionally, the present invention provides a sliding resistor formed by heating and curing a resistor paste containing a conductive material and the above binder resin. This sliding resistor, containing the binder resin of the present invention, has excellent sliding durability.

The binder resin of the present invention can inhibit wear in sliding resistors, thus providing a sliding resistor having excellent sliding durability to 50 million, or more than 100 million, sliding movements by a slider.

DESCRIPTION OF THE PREFERRED EMBODIMENTS

Figure 1:
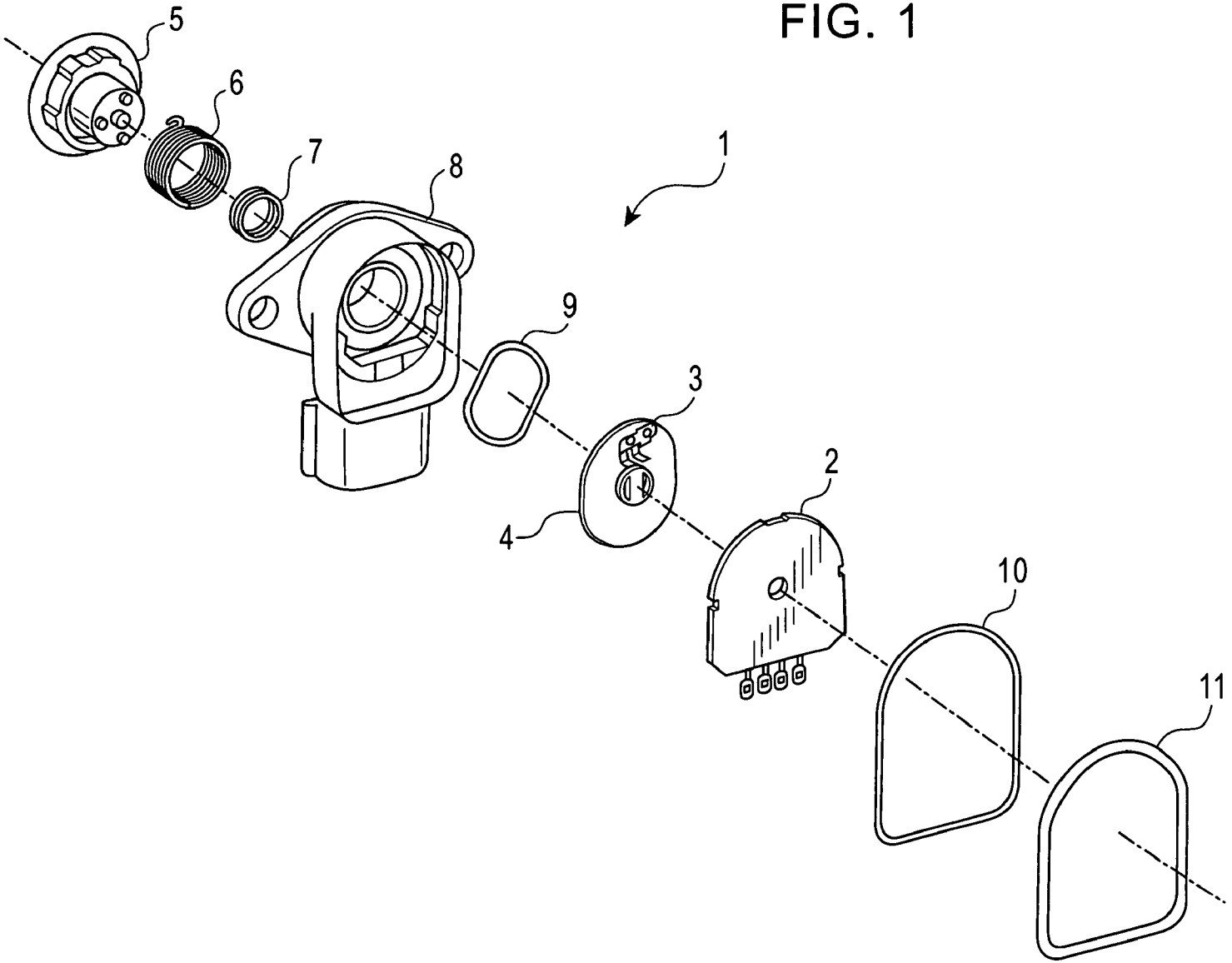
FIG. 1 is an exploded perspective view of a potentiometer used in Test Example 1.

The present invention will now be described in detail.

[Binder Resin]

A binder resin according to the present invention is characterized in that it contains an acetylene-terminated polyamic acid oligomer (hereinafter also referred to as an oligomer (I)) represented by the above general formula (I).

In addition to the oligomer (I), the binder resin of the present invention may further contain a thermosetting resin used conventionally as a binder resin for sliding resistors.

Examples of such a thermosetting resin include polyimide resin, phenol-formaldehyde resin, xylene resin, and epoxy resin.

Among them, polyimide resin is advantageous in view of sliding durability since this type of resin can be formed into a varnish and has been confirmed to resist heat generated by sliding movements. More preferably, the binder resin of the present invention further contains an acetylene-terminated polyisoimide oligomer, as disclosed in Japanese Patent No. 3372636, to achieve higher sliding durability. The acetylene-terminated polyisoimide oligomer is exemplified by an acetylene-terminated polyisoimide oligomer (hereinafter also referred to as an oligomer (II)) represented by the following general formula (II):

(II)

[Chemical Formula 2]

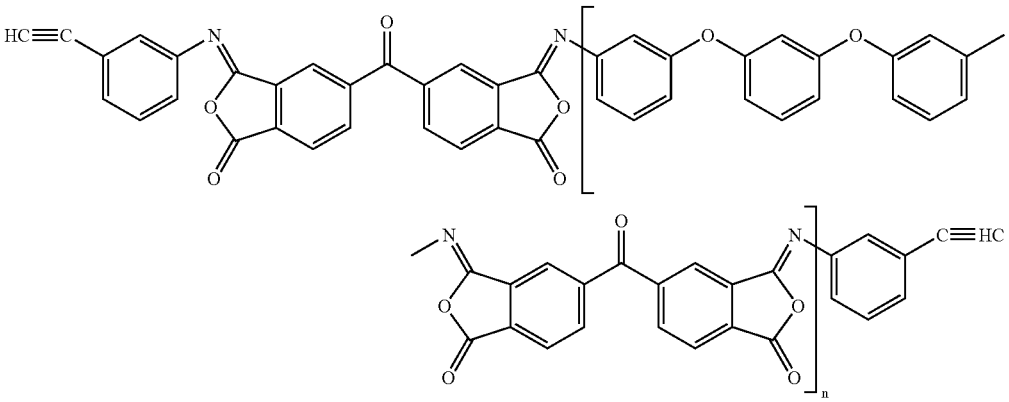

In the general formula (I), n is an integer of zero or more. The upper limit of n is preferably 10, though it is not particularly limited. More preferably, n is an integer of zero to four. Within this range, a resistor paste containing the binder resin exhibits a viscosity suitable for application by, for example, screen printing, so that a sliding resistor according to the present invention becomes easier to produce.

The oligomer (I) may be a single substance or a mixture of two or more substances having different molecular weights.

The oligomer (I) preferably has an average molecular weight of 700 to 5,000 in terms of polystyrene according to gel permeation chromatography (GPC). Within this range, the oligomer (I) advantageously has a higher glass transition temperature after heating and curing, thus exhibiting higher heat resistance.

The content of the oligomer (I) in the binder resin of the present invention preferably ranges from 1% to 100% by mass to provide a resistor having high sliding durability.

The oligomer (I) may be prepared by, for example, dissolving aminophenoxybenzene. (APB) and benzophenonetetracarboxylic dianhydride (BTDA) into a solvent such as tetrahydrofuran (THF), reacting the solution in the presence of a catalyst, and adding aminophenylacetylene to react the solution with it.

The oligomer (I), which is an intermediate of the oligomer (II), and the oligomer (II), which is a final product of the oligomer (I), have an equilibrium relation in a solution. A resistor paste prepared by, for example, dispersing the binder resin of the present invention into a solvent together with a conductive material preferably further contains the oligomer (II) to improve the stability of the oligomer (I).

The weight ratio of the oligomer (I) to the oligomer (II) in the binder resin of the present invention preferably ranges from 0.001 to 1, more preferably 0.01 to 0.5.

A mixture of the oligomers (I) and (II) may be prepared by, for example, adding a dehydrogenating agent to the above oligomer (I) solution to cause the ring closure condensation of carboxylic and amino groups in some oligomer (I) molecules.

[Sliding Resistor]

A sliding resistor of the present invention is formed by heating and curing a resistor paste containing a conductive material and the above binder resin of the present invention.

Examples of the conductive material used include carbon black, graphite, and carbon fiber.

Examples of the carbon black used include acetylene black, furnace black, and channel black. Among them, acetylene black is particularly effective because, for example, this material advantageously has a developed structure, its own slight reinforcing effect, and less changes with time in resistance.

The content of carbon black in the resistor paste preferably ranges from 5% to 50% by volume of the total solid content of the resistor paste. A resistor paste containing carbon black in an amount within this range has advantages such as sufficiently small contact resistance between the resistor and a slider for sliding applications and high sliding durability.

The graphite used may be, for example, flaky or amorphous. Graphite, which serves to reduce the resistance of the resistor, may be partially or completely replaced with carbon fiber. A proper amount of graphite, however, is preferably added because the graphite contained in the resistor paste is kneaded between a screen and a squeegee in printing to produce the effect of preventing changes with time in resistance.

The carbon fiber used may be a short fiber, such as milled carbon fiber and chopped carbon fiber, having a diameter of 1 to 40 μm and a length of 1 to 100 μm. The carbon fiber preferably has a diameter of 1 to 10 μm and a length of 1 to 30 μm. The carbon fiber, if having a diameter or length less than the above ranges, has a smaller contact area with the thermosetting resin contained in a resistor coating to exhibit less bonding strength. Such a carbon fiber is readily scraped off by sliding movements of a slider, thus providing no sufficient improvement in sliding life. The carbon fiber, if having a diameter or length more than the above ranges, is difficult to pass through the mesh of the screen used for printing, thus exhibiting significantly less printability. Such a carbon fiber is also undesirable because it causes slight fluctuations in resistance variation characteristics.

Carbon fiber need not be used as a conductive material and may be optionally added. If carbon fiber is used as a conductive material, the amount of carbon fiber added is preferably 50% or less by volume of the total solid content of the resistor paste. If the amount of carbon fiber added exceeds 50% by volume, fibers may overlap each other in the resistor to protrude their sharp edges through the surface of the resistor. Such protrusions cause a slider to wear down earlier.

The total content of the conductive material in the resistor paste preferably ranges from 5% to 50% by volume of the total solid content of the resistor paste. If the content of the conductive material is less than 5% by volume, the resistor exhibits extremely high resistance, thus leading to high contact resistance with a slider. If, on the other hand, the content of the conductive material is more than 50% by volume, the content of the binder resin is relatively decreased to result in a brittle resistor coating.

The content of the binder resin in the resistor paste preferably ranges from 50% to 95%, more preferably 75% to 85%, by volume. A resistor paste containing 75% or more by volume of the binder resin can provide a sliding resistor having excellent sliding durability to more than 100 million sliding movements.

Any additive that is generally added to resistors may be optionally added to the resistor paste. Examples of such additives include silane, titanate, and alumina coupling agents, hardening accelerators, and surface modifiers.

The resistor paste is prepared by, for example, properly weighing materials, such as the above conductive material and binder resin, according to the resistance required, dissolving the binder resin into a solvent, adding the conductive material and optional additives, and kneading the mixture in a dispersing and mixing machine such as a ball mill and a three roll mill.

The solvent used may be any solvent that can dissolve the binder resin. For example, one or more solvents selected from glycol solvents, ester solvents, and ether solvents may be used.

The sliding resistor of the present invention may be formed by applying the above resistor paste onto a substrate in a predetermined pattern by, for example, screen printing, and completely drying and curing the pattern.

The substrate used may be, for example, a ceramic, glass, or metal substrate.

The resultant resistor substrate, which has the resistor of the present invention, is slidably equipped with a slider to produce a potentiometer.

The above sliding resistor is preferably formed in a horseshoe or elongated shape on the substrate. For the horseshoe shape, the slider is mounted rotatably with respect to the substrate to provide a rotary potentiometer. For the elongated shape, the slider is mounted in a linearly sliding contact with the substrate to provide a linearly sliding potentiometer.

The slider may be made of a noble metal, which can keep a good contact with the resistor even in long-term sliding. Examples of the material used for the slider include nickel silver plated with gold or silver and alloys of metals such as palladium, silver, platinum, and nickel. If surface oxidation may occur at high temperature, a noble metal alloy is preferably used for keeping a stable contact.

If the substrate used is a metal substrate, particularly a mirror-finished metal substrate, the sliding resistor of the present invention may be transferred onto a resin substrate.

Examples of the material used for the resin substrate include thermosetting resins such as phenol resin, epoxy resin, and diallyl phthalate and thermoplastic resins such as nylon, polyethylene terephthalate (PET), polybutylene terephthalate (PBT), and polyphenylene sulfide (PPS).

The resistor may be transferred by, for example, applying the above resistor paste onto a mirror-finished metal substrate in a predetermined pattern by printing, completely drying and curing the pattern to form the resistor, placing the metal substrate onto a mold filled with a thermosetting or thermoplastic resin such that the resistor is positioned in the mold, curing the resin in the mold to form a resin substrate, and removing the metal substrate.

Transferring the sliding resistor of the present invention can further suppress an increase in contact resistance. In general, conductive particles such as carbon fiber produce irregularities having a size of about 1 to 3 μm on the surface of a resistor in contact with a slider. When the slider slides over the surface of the resistor, protrusions in the irregularities are readily scraped to leave a powder. This powder intervenes between the slider and the resistor to contribute to increased contact resistance. Transferring the resistor allows the slider to slide over a smooth surface of the resistor, thus further suppressing an increase in contact resistance.

EXAMPLES

Examples of the present invention will now be described.

Example 1

Binder resins were synthesized in the following procedure. First, 29.2 g of aminophenoxybenzene (APB) and 64.4 g of benzophenonetetracarboxylic dianhydride (BTDA)

were dissolved into about 300 g of tetrahydrofuran (THF) and were reacted in the presence of an antioxidant. Then, 23.4 g of aminophenylacetylene was added to prepare a solution containing the oligomer (I). Subsequently, a dehydrogenating agent was added to the solution to prepare a mixed solution of the oligomer (I) and the oligomer (II).

Half of the mixed solution was taken, and THF was removed to obtain about 44 g of binder resin A (a mixture of the oligomer (I) and the oligomer (II)). A sample was prepared by the KBr method and was analyzed with an infrared spectrometer. The analysis showed that the ratio of the oligomer (I) to the oligomer (II) in the binder resin A was 0.2, which was the ratio of the peak at 1,550 $cm^{-1}$, namely the absorption wavelength of the amic acid, to the peak at 940 $cm^{-1}$, namely the absorption wavelength of the isoimide. The binder resin A had an average molecular weight of $3.1\times10^2$.

The above mixed solution was further dehydrogenated to obtain a solution containing only the oligomer (II). THF was removed from the solution to obtain about 40 g of binder resin B (the oligomer (II)). This binder resin B had an average molecular weight of $3.1\times10^2$.

Subsequently, 100 parts by mass of each of the resultant binder resins A and B was mixed with 130 parts by mass of methyltriglyme to prepare varnishes. Then, 41.7 parts by mass of carbon black (acetylene black), as a conductive material, and 31.9 parts by mass of milled carbon fiber having a diameter of 7 μm and a length of 30 μm were added to each varnish, which was mixed and dispersed using a three roll mill to prepare resistor pastes A and B.

The resistor pastes A and B were applied onto substrates by screen printing to form arc-shaped layers. These layers were dried and cured by heating them at 150° C. to 400° C. for two to six hours to form resistors A and B on the substrates, thus providing resistor substrates A and B.

Test Example 1

The sliding durability of the resistors A and B produced in Example 1 was examined with a potentiometer. FIG. 1 is an exploded perspective view of the potentiometer.

In FIG. 1, a potentiometer 1 includes a resistor substrate 2 having an arc-shaped resistor pattern, a rotator 4 having a slider 3 made of a noble metal contact brush, and a casing accommodating the resistor substrate 2 and the rotator 4. The casing is composed of a bearing 5, a coil spring 6, a seal ring 7, a main body 8, a spring washer 9, a waterproof ring 10, and a lid 11. In this test example, the resistor substrates A and B produced in Example 1 were used as the resistor substrate 2.

The test conditions were as follows:

Slider: noble metal contact brush (containing silver, palladium, and copper)

Sliding conditions: sliding angle=5°; sliding cycle=50 Hz

Sliding environment temperature: −40° C. to 150° C.

Figure 2:
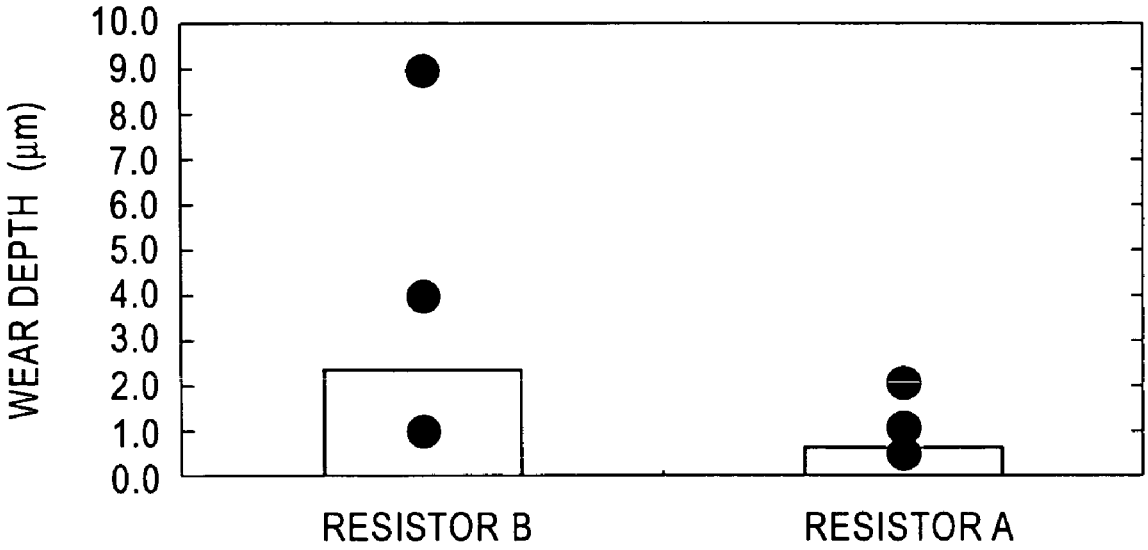
FIG. 2 is a graph showing the results of Test Example 1.

The wear depth of the resistors A and B after 100 million sliding movements was measured under the above test conditions. The results are shown in FIG. 2, in which the vertical axis indicates the wear depth (μm), the black circles indicate the individual wear depths, and the bar graphs indicate average wear depths.

According to the results, the resistors A, which were formed with the binder resin A containing the oligomer (I), exhibited a small average wear depth, namely about 0.5 μm, after 100 million sliding movements. These results indicate that the resistors A had excellent sliding durability.

What is claimed is:

1. A sliding resistor formed by heating and curing a resistor paste that is prepared by mixing and dispersing a conductive material in a binder resin, the binder resin comprising a mixture of an acetylene-terminated polyamic acid oligomer [I] represented by the following general formula (I):

(I)

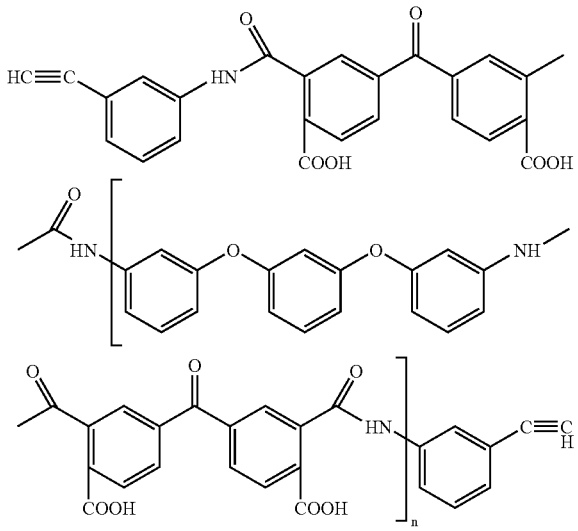

wherein n is an integer of zero or more, and an acetylene-terminated polyisoimide oligomer [II] represented by the following general formula (II):

(II)

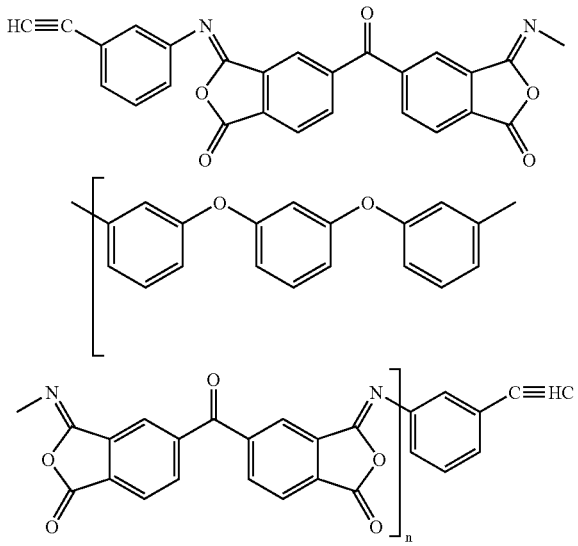

wherein n is an integer of zero or more, wherein the conductive material includes at least carbon black, and the content of carbon black ranges from 5% to 50% by volume of the total solid content of the resistor paste.

2. The sliding resistor of claim 1, wherein n is an integer of zero to four in the general formula (I).

3. The sliding resistor of claim 1, wherein the carbon black is acetylene black.

4. The sliding resistor of claim 1, wherein the conductive material further includes carbon fiber.

5. The sliding resistor of claim 1, wherein the carbon fiber is milled carbon fiber.

6. The sliding resistor of claim 4, wherein the carbon fiber has a diameter of 1 to 10 μm and a length of 1 to 30 μm.

7. The sliding resistor of claim 4, wherein the content of the carbon fiber in the resistor paste is 50% by volume or less of the total solid content of the resistor paste.

8. The sliding resistor of claim 1, wherein the weight ratio of the acetylene-terminated polyamic acid oligomer [I] to the acetylene-terminated polyisoimide oligomer [II] ranges from 0.01 to 0.5.

* * * * *